US007696878B2

(12) United States Patent
Cable et al.

(10) Patent No.: US 7,696,878 B2
(45) Date of Patent: Apr. 13, 2010

(54) RFID KEY SWITCH WITH INTEGRATED KEY CIRCUITRY

(75) Inventors: Frederick P. Cable, Springfield, IL (US); Stephen P. White, Springfield, IL (US)

(73) Assignee: Honeywell International Inc., Morristown, NJ (US)

( * ) Notice: Subject to any disclaimer, the term of this patent is extended or adjusted under 35 U.S.C. 154(b) by 142 days.

(21) Appl. No.: 11/803,322

(22) Filed: May 13, 2007

(65) Prior Publication Data

US 2008/0278326 A1 Nov. 13, 2008

(51) Int. Cl.
*G08B 13/14* (2006.01)

(52) U.S. Cl. ..... 340/572.1; 340/426.3; 340/5.62; 70/278.3; 307/10.3

(58) Field of Classification Search ..... 340/426.3, 340/426.35, 572.1, 5.72, 5.6, 5.7, 561, 542, 340/6.61, 5.62, 5.55; 70/278.3, 336, 339, 70/186, 184, 185; 235/449; 307/10.2, 10.3, 307/10.5, 103

See application file for complete search history.

(56) References Cited

U.S. PATENT DOCUMENTS

| | | | | |
|---|---|---|---|---|
| 5,836,187 | A * | 11/1998 | Janssen et al. | 70/252 |
| 6,442,985 | B1 | 9/2002 | Watanuki et al. | |
| 2003/0169148 | A1 * | 9/2003 | Takamura et al. | 340/5.7 |
| 2004/0159135 | A1 | 8/2004 | Kato et al. | |

FOREIGN PATENT DOCUMENTS

| | | | |
|---|---|---|---|
| FR | 2755791 | A1 | 5/1998 |

* cited by examiner

*Primary Examiner*—Anh V La

(57) ABSTRACT

A system and method for enhanced security by incorporating RFID processing circuitry within a key switch assembly. The RFID key switch assembly includes four subassemblies; the key/tumbler assembly, rotating and stationary switch contacts, RFID Processing Circuitry and an electrical connection interface. The RFID Processing Circuitry incorporated in the key switch assembly reads RF signals transmitted from an RFID tag embedded in a key inserted into the key switch.

15 Claims, 3 Drawing Sheets

RFID KEY SWITCH WITH INTEGRATED KEY CIRCUITRY

TECHNICAL FIELD

Embodiments are generally related to Radio frequency identification (RFID) systems and techniques. Embodiments are also related to RFID key switch. Embodiments are additionally related to directly incorporating RFID processing circuitry within key operated system housing.

BACKGROUND OF THE INVENTION

Radio frequency identification systems (RFID) can be used to detect and prevent inventory shrinkage and to perform inventory management functions in a variety of retail establishments, apparel and mass merchandisers, supermarkets, libraries, video stores, and the like. RFID technology provides an inexpensive and simple way to mark and identify physical objects using machine-readable information.

RFID systems can identify objects at greater distances than optical systems, store information into read/write tags, operate unattended, and read tags hidden from visual inspection for security purposes. RFID technology can be applied to identify electronic components, devices, and systems to provide functions such as, for example, security of the assets, inventory tracking of the assets, identification of the assets, and short distance communication between the assets.

RFID tags are currently integrated into electronic components, devices and systems at the component level (i.e., circuit chip circuit board etc.), the asset level (i.e., box, computer, etc.) or system level (i.e., network system, computer system, etc.). Often RFID tags are used in conjunction with key operated switches to add an enhanced security feature beyond that of the cut or shape of the key.

One of the problems with such prior art techniques is that circuitry involved in the processing of the RFID signal transmitted from RIFD tags is typically housed in a separate module from the key switch housing. The separate module adds to overall system package size, installation real estate, parts count, and assembly steps involved in the manufacturing and installation processes.

Based on the foregoing, a need exists to solve the multiple, separate module issue by incorporating all RFID processing circuitry directly into the housing of the key switch assembly itself, thereby enhancing security and limiting space requirements for the overall system.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved RFID key switch assembly.

It is another aspect of the present invention to incorporate RFID processing circuitry into the housing of the key switch system.

It is a further aspect of the present invention to provide for an RFID-enhanced, key operated switch for enhanced security.

The aforementioned aspects and other objectives and advantages can now be achieved as described herein. The invention includes an RFID key switch which can be used in any application where a typical key operated switch is employed. The RFID key assembly includes four subassemblies. The Key/Tumbler Assembly is the first main subassembly enables the insertion of key into the keyed switch, providing a means to rotate internal switch contacts. The second main assembly can be RFID Processing Circuitry which operates to read transmitted RF signals from an RFID tag associated with a key. Rotating and stationary switch contacts make up the third subassembly, which provide the function of opening and closing contacts within the switch, which ultimately serve to inactivate or activate equipment usage. The fourth subassembly is an electrical connection interface which enables the switch to be coupled to associated equipment and enables the transmission of closed circuit status and/or RFID code information from the processing circuitry to the equipment upon which the switch is installed to be utilized. The RFID processing circuitry is directly incorporated into the key switch housing itself, thereby eliminating the need for separate modules and simplifying installation.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
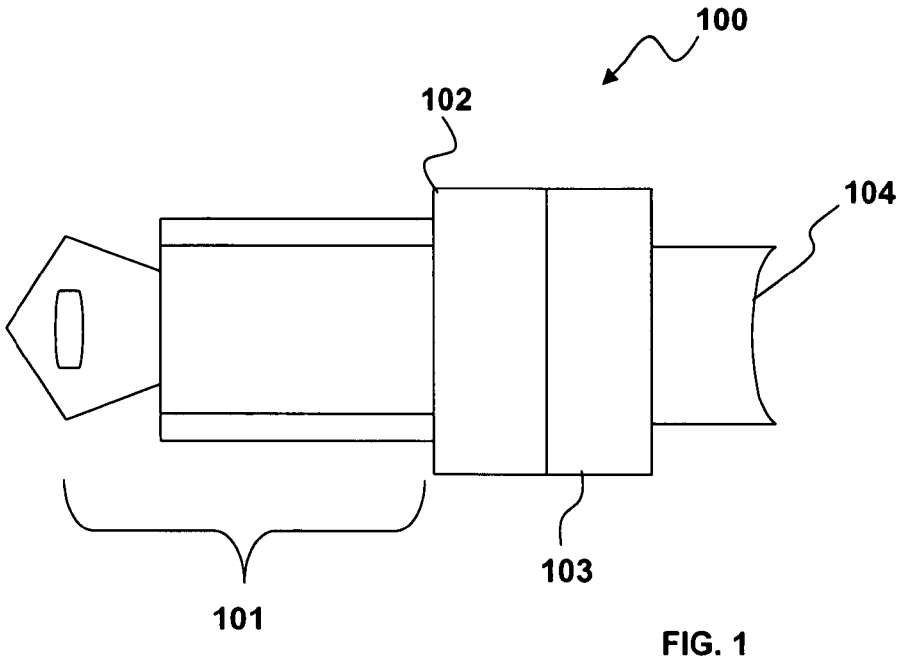
FIG. 1 is an illustration of the four main modules that comprise a RFID-enabled key switch assembly, which can be implemented in accordance with a preferred embodiment.

Referring to FIG. 1, what is illustrated is an RFID-enabled key switch assembly 100 in accordance with features of the present invention. An RFID-enabled key switch assembly 100, which can be implemented in accordance with a preferred embodiment, includes four main subassemblies. The four main components includes an RFID key and tumbler assembly module 101, rotating and stationary contact assembly module 102, RFID processing circuitry module 103 and an electrical connection interface 104.

Figure 2:
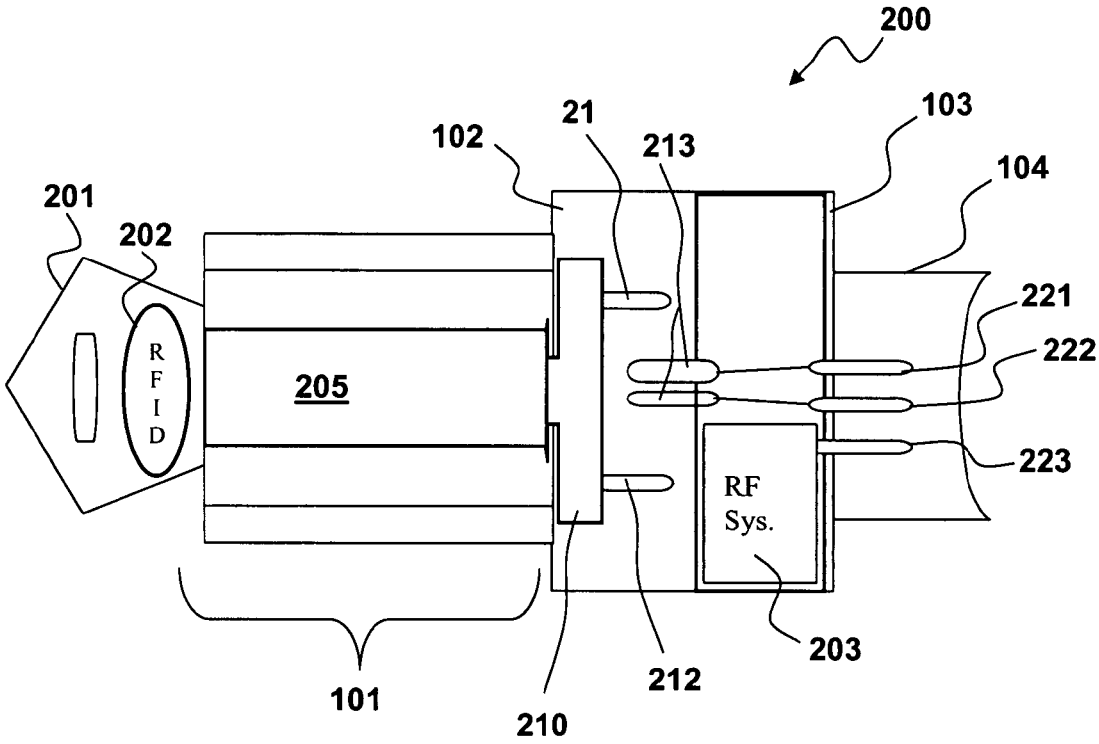
FIG. 2 is a cross section view of the RFID-enabled key switch assembly illustrated in FIG. 1, but further illustrating operating components within the RFID-enabled key switch assembly, which can be implemented in accordance with a preferred embodiment.

As is well known in the art, key and tumbler assemblies allows for the insertion of the key into the assembly to provide a means for rotating the internal mechanism. Referring to FIG. 2, across-sectional view 200 of the RFID-enabled key switch assembly shown in FIG. 1 is illustrated. As shown in FIG. 2, a key 201 including an embedded RFID tag 202 is inserted into the key and tumbler assembly module 101 wherein a tumbler 205, which is coupled to rotating switch and contact assembly 210 located within rotating and stationary contact assembly module 102, can be rotated by rotation of a valid key 201 and thereby enable the rotation of the rotating switch contact assembly 210 so that rotating contacts 212 located thereon can come into electrical contact with stationary contacts 213. After installing the key 201 into the switch 103, the RFID signals transmitted from the RFID tag 202 embedded in the key 201 can be read by the RFID processing circuitry 203. If rotation of the key 201 within the tumbler assembly module 101 is successful, an electrical circuit is closed contact between rotating contacts 212 and stationary contacts 213. Assuming that the RFID tag is authenticated/validated by the RFID processing circuitry 203, then signals can be passed into equipment (not shown) though contacts 221, 222 and 223 assuming a coupling with the equipment via the electrical connection interface 104.

It can be appreciated that the electrical connection interface 104 can comprise of wire leads, an integral connector, or screw terminals (not shown in figure), having the purpose of transmitting the RFID code from the processing circuitry 203 to the equipment upon which the switch assembly 200 can be installed.

Figure 3:
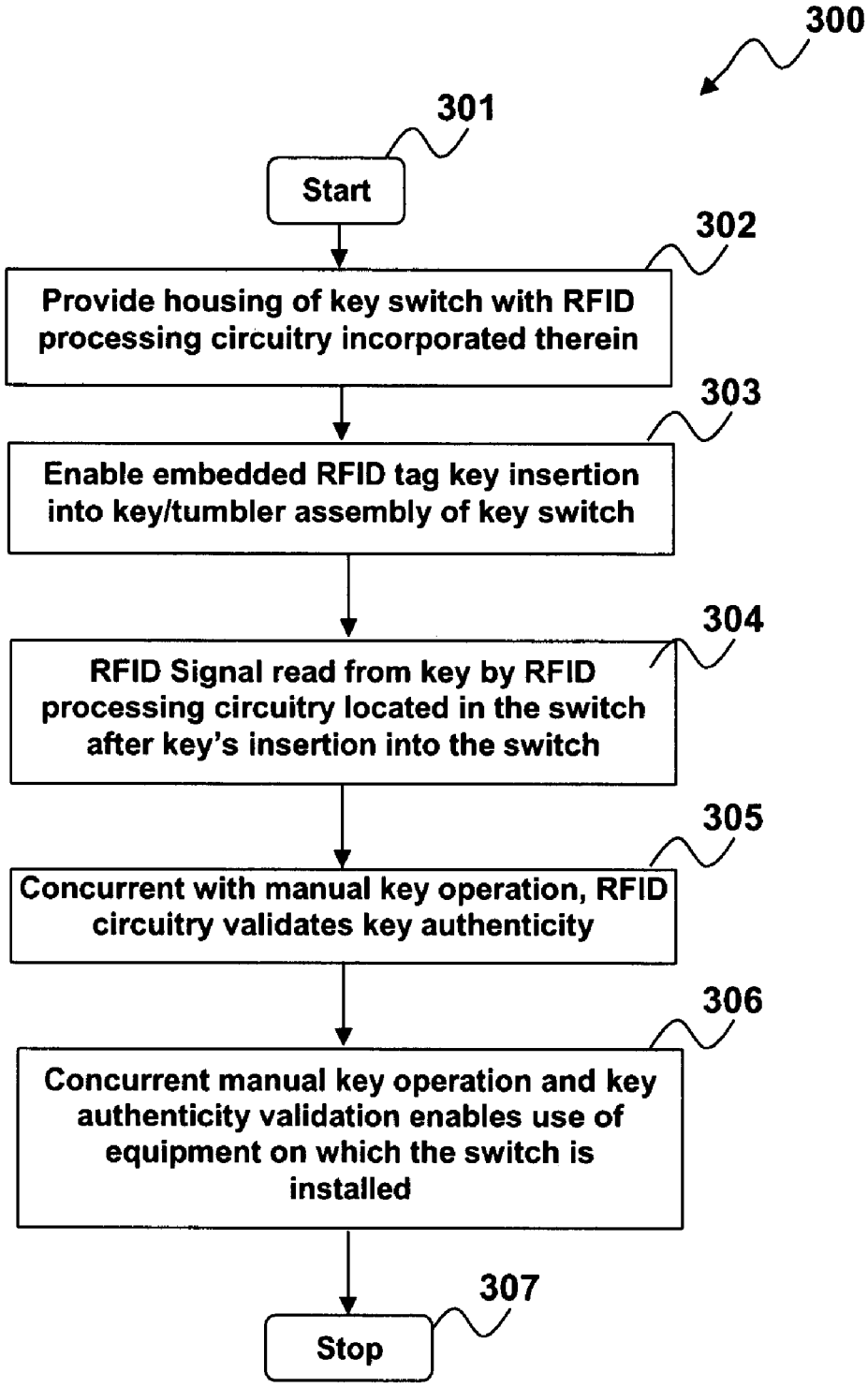
FIG. 3 illustrates a high-level flow chart of logical operational steps of a method, which can be implemented in accordance with a preferred embodiment.

Referring to FIG. 3, illustrated is a high-level flow chart of logical operational steps of a method 300, which can be implemented in accordance with a preferred embodiment. As depicted at block 301, the process can begin. Next, as indicated at block 302, a key switch assembly incorporating RFID processing circuitry within its housing is provided, thereby eliminating the need for a separate module. Thereafter, as described at block 303, an RFID tag key's insertion into the key and tumbler assembly of the key switch is enabled. Next, as indicated at block 304 and RFID signal is read from the key by RFID processing circuitry located within the switch after the key's insertion into the switch. Thereafter, as illustrated at block 305, the RFID circuitry validates the key's authenticity concurrent with manual key operation. Then, as shown in block 306, concurrent manual key operation and key authenticity validation enables use of equipment on which the switch is installed. Thereafter, as described at block 307, the access process terminates.

Figure 4:
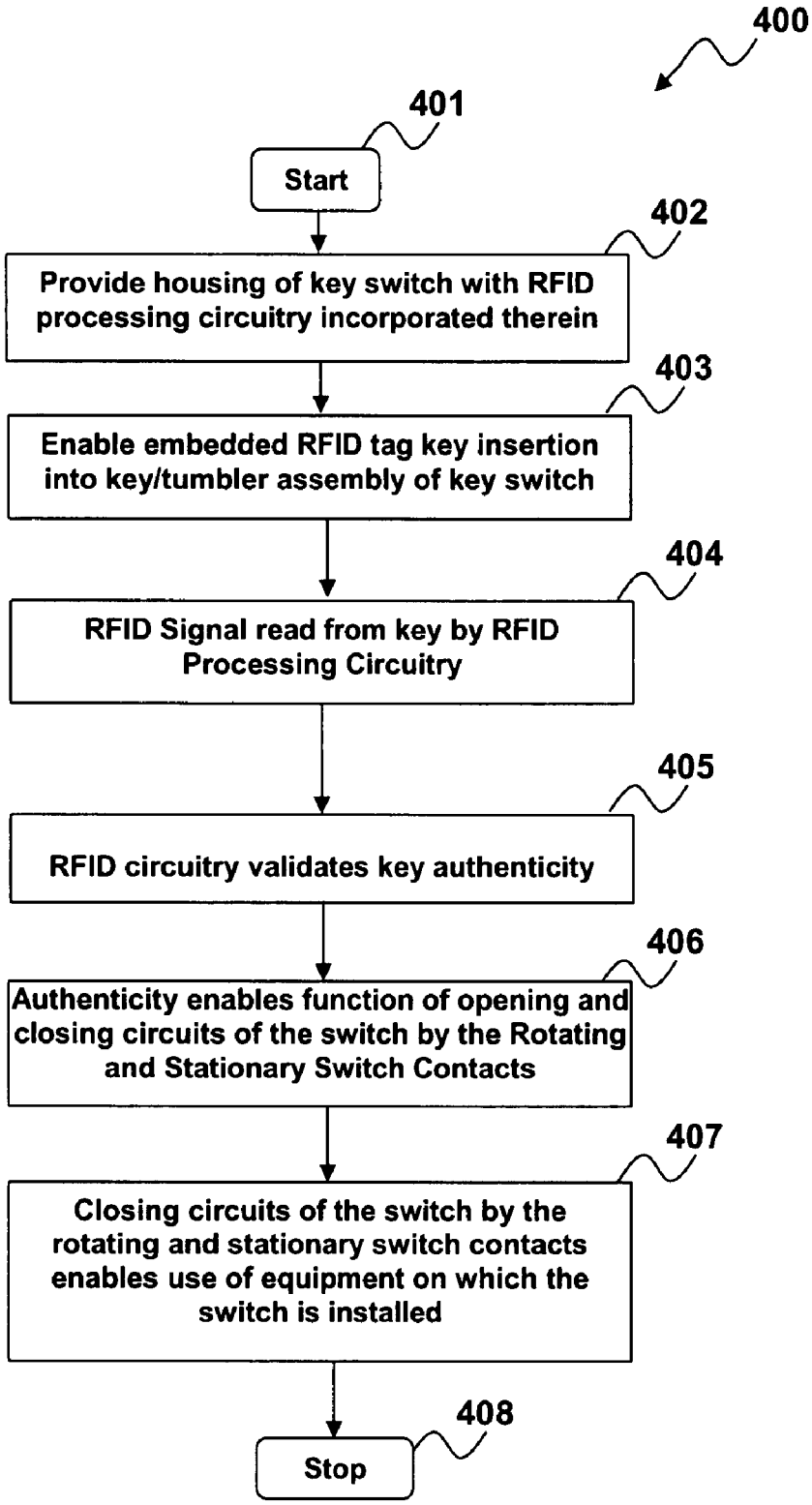
FIG. 4 illustrates another high-level flow chart of logical operational steps of a method, which can be implemented in accordance with a preferred embodiment.

Referring to FIG. 4, illustrated is a high-level flow chart of alternative operational steps for a method 400 of using the invention, which can be implemented in accordance with a preferred embodiment. In this case RFID authentication enables operation of the key's rotation. The process begins as shown in block 401. Then, as depicted at block 402, a housing of a key switch is provided with RFID processing circuitry incorporated therein. Then as shown in block 403, RFID tag key insertion into the key and tumbler assembly of the key switch is enabled. Thereafter, as shown in block 404, an RFID signal is read from the key by RFID processing circuitry. Then, as shown in block 405, the RFID circuitry validates the key's authenticity. Then, as shown in block 406, authentication of the key enables functions of opening and closing circuits of the switch by the rotating and stationary contacts. Thereafter, as shown in block 407, circuits of the switch are closed by contact between rotating and stationary switch contacts thereby enabling use of equipment on which the switch is installed. The process then terminates as shown in block 408.

The RFID key operated switch finds wide field of application including all terrain vehicles, automobiles, golf carts, utility vehicles, material handling equipment, lawn care equipments, mobile work platforms and home security. The invention also prospects application in boom lifts, construction equipments, go karts, snow mobiles, watercraft, elevators, and any other asset that requires key operated switch for enhanced security.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A key switch assembly, comprising:

a key and tumbler assembly coupled to a rotating contact assembly including rotating contacts configured to make electrical contact with stationary contacts following rotation of a key within the key and tumbler assembly;

RFID processing circuitry; and an electrical connection interface;

wherein insertion of a key including an embedded RFID tag thereon into the key and tumbler assembly causes said RFID processing circuitry to receive an RF signal from the RFID tag for authentication of the RFID tag, and wherein a signal is sent from the RFID processing circuitry together with a signal from stationary contacts when in electrical contact with the rotating contacts, said signals enabling use of equipment associated with the key switch.

2. The assembly of claim 1, wherein said key and tumbler assembly is configured to enable the insertion of an RFID embedded key to rotate said rotating contact assembly and make electrical contact with the stationary contacts if the RF signal is authenticated by the RFID processing circuitry.

3. The assembly of claim 1, wherein said electrical connection interface transmits the RFID code from said processing circuitry to a vehicle or equipment on which said switch is installed.

4. A key switch assembly, comprising:

a key and tumbler assembly coupled to a rotating contact assembly including rotating contacts;

stationary contacts;

RFID processing circuitry; and an electrical contact assembly;

wherein insertion of a key including an embedded RFID tag thereon into the key and tumbler assembly causes said RFID processing circuitry to receive an RF signal from the RFID tag for authentication of the RFID tag, and wherein a signal is sent from the RFID processing circuitry together with a signal from stationary contacts when in electrical contact with the rotating contacts, said signals enabling use of equipment associated with the key switch.

5. The assembly of claim 4, wherein said key and tumbler assembly is configured to enable the insertion of an RFID embedded key to rotate said rotating contact assembly and make electrical contact with the stationary contacts if the RF signal is authenticated by the RFID processing circuitry.

6. The assembly of claim 4, wherein an electrical connection interface transmits the RFID code from said processing circuitry to a vehicle or equipment on which said switch is installed.

7. The assembly of claim 4, wherein said key and tumbler assembly allows for the insertion of said key for rotating said switch contacts.

8. A method using a RFID-enabled key switch assembly to authorize equipment usage, comprising;

providing a key switch housing comprising RFID processing circuitry and a key and tumbler assembly therein;

enabling an embedded RFID tag key to be inserted into the key and tumbler assembly;

reading an RF signal from the embedded RFID tag by said RFID processing circuitry to validate key authenticity;

enabling rotation of said key and tumbler assembly to enable use of equipment following authenticity by said RFID processing circuitry; and wherein the key switch housing further comprises said key and tumbler assembly coupled to a rotating contact assembly including rotating contacts configured to make electrical contact with stationary contacts following rotation of RFID tag key within said key and tumbler assembly.

9. The method of claim 8 wherein insertion of said RFID tag key into the key and tumbler assembly causes said RFID processing circuitry to receive an RF signal from the RFID tag for authentication of the RFID tag, and wherein a signal is sent from the RFID processing circuitry together with a signal from stationary contacts when in electrical contact with the rotating contacts, said signals enabling use of equipment associated with the key switch.

10. An RFID tag key switch system, comprising:

a key including an embedded RFID tag thereon;

a key and tumbler assembly coupled to a rotating contact assembly including rotating contacts configured to make electrical contact with stationary contacts following rotation of a key within the key and tumbler assembly;

RFID processing circuitry; and an electrical connection interface;

wherein insertion of said key into the key and tumbler assembly causes said RFID processing circuitry to receive an RF signal from the RFID tag for authentication of the RFID tag, and wherein a signal is sent from the RFID processing circuitry together with a signal from stationary contacts when in electrical contact with the rotating contacts, said signals enabling use of equipment associated with the key switch.

11. The system of claim 10, wherein said key and tumbler assembly is configured to enable the insertion of an RFID embedded key to rotate said rotating contact assembly and make electrical contact with the stationary contacts if the RF signal is authenticated by the RFID processing circuitry.

12. The system of claim 10, wherein said electrical connection interface transmits the RFID code from said processing circuitry to a vehicle or equipment on which said switch is installed.

13. The system of claim 12, wherein said key and tumbler assembly is configured to enable the insertion of an RFID embedded key to rotate said rotating contact assembly and make electrical contact with the stationary contacts if the RF signal is authenticated by the RFID processing circuitry.

14. The system of claim 11, wherein said electrical connection interface transmits the RFID code from said processing circuitry to a vehicle or equipment on which said switch is installed.

15. The system of claim 10, wherein said key and tumbler assembly allows for the insertion of said key for rotating said switch contacts.

* * * * *